United States Patent [19]

Hamada et al.

[11] Patent Number: 4,792,239

[45] Date of Patent: Dec. 20, 1988

[54] FLEXIBLE CASE HANGING DEVICE

[75] Inventors: Hiroshi Hamada; Takamitsu Watanabe; Mitiharu Suzuki, all of Tokyo, Japan

[73] Assignee: Kawasaki Kisen Kaisha, Hyogo, Japan

[21] Appl. No.: 141,371

[22] Filed: Jan. 7, 1988

[30] Foreign Application Priority Data

Jan. 8, 1987 [JP] Japan ..... 62-623[U]

[51] Int. Cl.[4] ..... B65D 33/14

[52] U.S. Cl. ..... 383/22; 383/16; 220/403; 24/287; 24/17 A; 24/69 CD

[58] Field of Search ..... 383/22, 6, 16; 220/403, 220/404; 105/423; 24/287, 17 A, 129 A, 68 CD, 70 ST

[56] References Cited

U.S. PATENT DOCUMENTS

| | | | |
|---|---|---|---|
| 1,551,914 | 9/1925 | Sturges | 24/17 A |
| 2,603,264 | 7/1952 | Cautley | 383/22 |
| 4,214,350 | 7/1980 | Copelan | 24/68 CD X |
| 4,674,127 | 6/1987 | Yamada et al. | 383/6 |

FOREIGN PATENT DOCUMENTS

| | | |
|---|---|---|
| 17864 | 2/1973 | Japan . |
| 114346 | 7/1984 | Japan . |
| 128984 | 8/1984 | Japan . |
| 128985 | 8/1984 | Japan . |
| 128986 | 8/1984 | Japan . |
| 129311 | 8/1984 | Japan . |
| 99274 | 6/1985 | Japan . |

*Primary Examiner*—Stephen Marcus
*Assistant Examiner*—Nova Stucker
*Attorney, Agent, or Firm*—Pollock, VandeSande & Priddy

[57] ABSTRACT

A flexible case hanging device for hanging and extending a flexible case such as an inner bag for a container comprises a belt member one end of which is fixed to a side edge along one edge of a corner of the inner bag and a free end of which is anchored by a buckle provided on a side edge along the other edge of the corner, and an annular body provided at a vertex of the corner. Part of the belt member passes through the annular body to form a loop of the belt member. The loop is adjustable into smaller sizes by pulling the free end of the belt member. The loop is fixed to an inner wall of the container. The free end of the belt member is fixed by the buckle. When the free end of the belt member is pulled to make smaller the loop of the belt member, the side edge and the vertex of the corner of the inner bag can be pulled to eliminate or prevent slack of the bag.

5 Claims, 2 Drawing Sheets

FLEXIBLE CASE HANGING DEVICE

BACKGROUND OF THE INVENTION

FIELD OF THE INVENTION

This invention relates to a flexible case hanging device, and more particularly to a hanging device for hanging and extending an inner bag in a transport container.

In transportation with containers, inner bags have been used in the containers for preventing articles or goods therein from being contaminated. The inner bag is hung from inner walls of the container by means of hangers so as to be extended as wide as possible in the container. The articles or goods are accomodated in the inner bag and transported.

FIG. 1 is a schematic perspective view illustrating a hitherto used inner bag for a container having hangers (for example disclosed in Japanese Laid-open Patent Application No. 49-105,686).

The inner bag shown in FIG. 1 comprises an upper surface 10, a bottom surface 12, a rear surface 14, side surfaces 16 and 18 and a front surface 20 to form a hexahedron, and further comprises hangers 22 and 24 and dump-up fixtures 26 for connecting the inner bag to the inside of the container. The inner bag includes charging openings 28 and a small discharging opening 30. Reference numerals 32 and 34 denote a screen canvas and a skirt canvas to form the front surface 20.

The hangers 22 and 24 usually in the form of hooks or strings are independently provided on side edges along edges of the inner bag, on the other hand mounting portions are provided on the inner walls of the container correspondingly to these hangers 22 and 24. In arranging and extending the inner bag in the container, the hangers 22 and 24 are hung on or bound to the mounting portions of the container.

With such hitherto used hangers for a case or bag, however, it is impossible to remove or prevent slack of the case or bag occurring when the bag is extended in a container.

In these hangers, moreover, the case or inner bag is hung from the inner walls of the container at several points of the bag, so that upon being subjected to load, it tends to cause stress concentration at the supported points of the bag resulting in damage or breakdown of the bag.

In case of inner bags of containers, particularly, ropes are often provided on upper surfaces of the inner bags for preventing the slack of the inner bags. However, such ropes in addition to the hanging means cause a new problem of making the construction complicated.

It is an object of the invention to provide a flexible case hanging device which eliminates all the disadvantages of the prior art and which is able to eliminate or prevent slack of a flexible bag and mitigate stress concentration occurring at hung portions of the case.

SUMMARY OF THE INVENTION

In order to achieve this object, the flexible case hanging device according to the invention comprises a belt member having one end fixed to a side edge along one edge of a corner of a case and a free end anchored by a buckle provided on a side edge along the other edge of the corner, and an annular body provided at a vertex of said corner, part of said belt member passing through said annular body to form a loop of the belt member, which is adjustable into smaller sizes by pulling said free end of the belt member.

In a preferred embodiment, the device further comprises an auxiliary fastener which comprises a belt cloth fixed to a side edge along an edge of the case, an annular body fixed to the belt cloth, a buckle fixed to the belt cloth on a side opposite to the annular body and a belt member having one end fixed to the belt cloth between the annular body and the other free end anchored by the buckle, part of the belt member passing through the annular body to form a loop of the belt member, which is adjustable into small sizes by pulling the free end of the belt member.

In hanging and extending a flexible case by the hanging device constructed as above described, the loop is directly or indirectly fixed to an attaching portion of, for example, an inner wall of a container, and further the free end of the belt member is fixed by the buckle. Therefore, the side edges on one side and the other side are supported through the belt member and vertexes of corners of the case are supported through annular bodies to distribute the supporting force, thereby enabling the flexible case to be hung and extended with mitigated stress concentration.

Moreover, as the free end of the belt member is pulled to make smaller the loop of the belt member, the side edges on one side and the other side of the case and the vertex of the corner of the case can be pulled to eliminate or prevent slack of the case.

BRIEF DESCRIPTION OF THE DRAWINGS

The invention will be more fully understood by referring to the following detailed specification and claims taken in conjunction with the appended drawings.

DETAILED DESCRIPTION OF PREFERRED EMBODIMENTS

Figure 1:
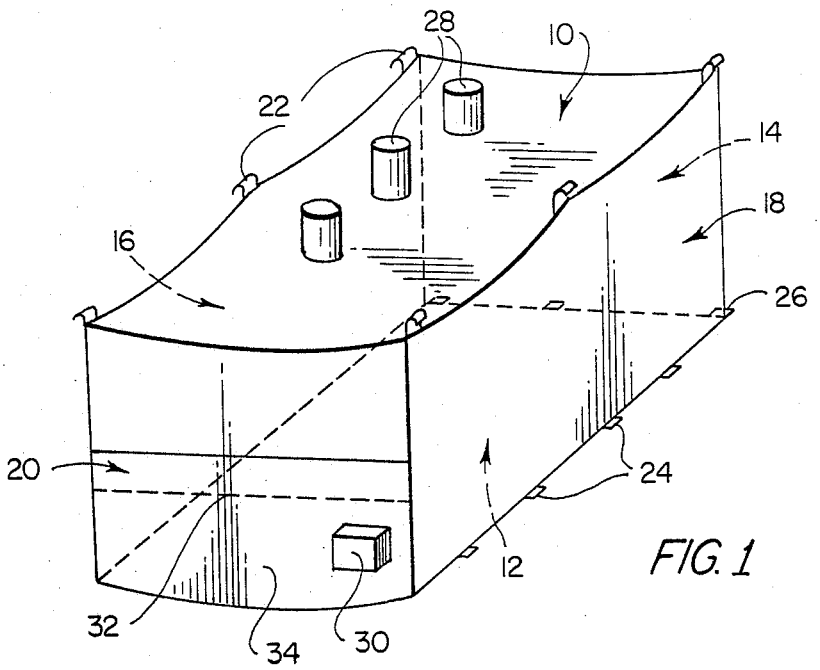
FIG. 1 is a perspective view illustrating an inner bag for a container as a whole for explaining the case hanger of the prior art.

The attached drawings for explaining the invention are so schematic to an extent that the invention can be substantially understood and therefore shapes, dimensions and positional relations between the respective components of the invention are not limited to those shown in the drawings.

Figure 2:
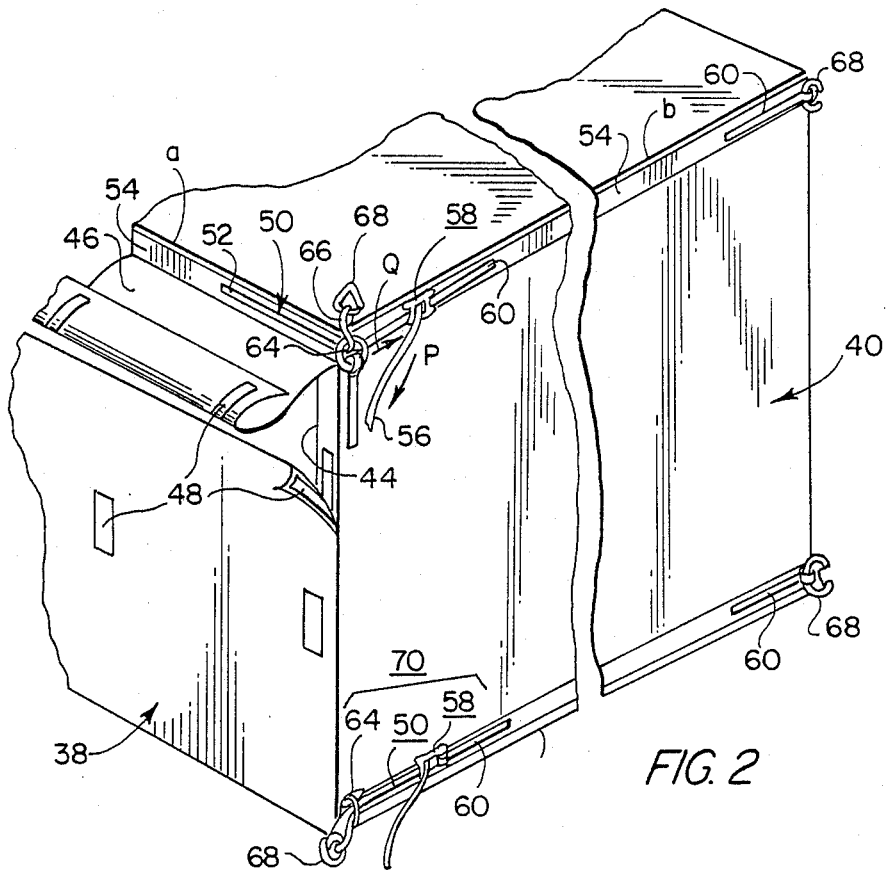
FIG. 2 is a perspective view showing a principal part of an inner bag for a container to which is applied one embodiment of the invention.

FIG. 2 is a perspective view of a principal part of an inner bag for a container having the hanging device as one embodiment of the invention. This embodiment applied to the inner bag for the container will be explained hereinafter.

Referring to FIG. 2, reference numerals 38,40 and 42 denoted a front surface, a side surface and an upper surface of the container inner bag (referred to hereafter as only "inner bag") to form a substantial hexahedron in the same manner as in the inner bag of the prior art.

Moreover, reference numeral 44 denotes an opening of the inner bag, which is covered by a cover member 46. Although the constitution of the inner bag is not limited to those shown in the drawing, the inner bag of this embodiment is provided with the opening 44 at the upper part of the front surface 38 and with the cover member 46 extending from an upper end of the opening 44. The opening 44 is opened and closed by opening and closing the cover member 46. Reference numeral 48 in the drawing illustrates jointing means, for example, magic tape (trade name).

Figure 3:
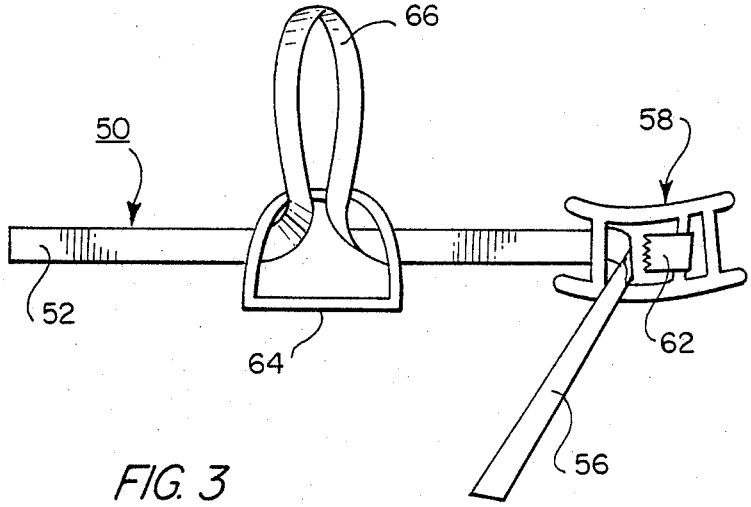
FIG. 3 is a perspective view illustrating one embodiment of the invention.

FIG. 3 is a schematic perspective view illustrating one embodiment of the invention.

In FIGS. 2 and 3, a belt member 50 has one end or fixed end 52 fixed to a side edge along one edge, for example, edge a at a corner of a case, for example, an inner bag of a container.

In the embodiment shown in the drawings, the fixed end 52 is fixed to the side edge along the edge a on the upper side of the front surface 38. In other words, the hanging device according to this embodiment is provided at an upper corner of the front surface 38. Moreover, the fixing means for the fixed end 52 of the belt member 50 may be any suitable means, such as sewing, welding, adhering or the like. Reference numeral 54 denotes a belt cloth which in this embodiment is fixed to the side edge along the edge a by sewing in order to reinforce the side edge of the inner bag. Therefore, the fixed end of the belt member 50 is fixed to the side edge through the belt cloth 54.

Moreover, a buckle 58 is provided on a side edge along another edge, for example, the edge b of the corner for anchoring a free end 56 of the belt member 50.

In the illustrated embodiment, the belt cloth 54 is also fixed to, for example, the side edge along the edge b at the upper end of the side surface 40, and the buckle 58 is fixed to the belt cloth 54 through a belt member 60. The buckle 58 is provided with a stopper 62 which is inoperative when the free end 56 of the belt member 50 is pulled in a direction as shown, for example, by an arrow P such that the free end 56 is not anchored. On the other hand, when the free end 56 is pulled in a direction shown by an arrow Q opposite to the direction P, the stopper 62 is operative to anchor the free end 56 of the belt member 50.

Moreover, an annular body 64 is located at a vertex of the corner. Part of the belt member 50 passes through the annular body 64 to form a loop 66 which is adjustable to a smaller loop by pulling the free end 56. The "vertex of the corner" referred to herein means a point of intersection of the edges (for example, the edges a and b at the corner and the corner itself in the proximity of the point of intersection.

In the illustrated embodiment, the annular body 64 is also fixed to the vertex of the corner through the belt member 60. The part of the belt member 50 between the fixed and free ends 52 and 56 is partially extended through the annular body 64 to form the loop 66. In this embodiment, the loop 66 is connected through a fastening ring 68 to an attaching portion (not shown) on an inner wall of the container.

With the hanging device provided at the corner of the inner bag of the container as above described, when the free end 56 is pulled into the direction P, the length of the belt member 50 extending from the buckle 58 to the fixed end 52 is shortened to make smaller the loop 66. As a result of the reduction of the loop 66, the side edges of the inner bag along the edges a and b can be pulled toward the vertex of the corner to which the annular body 64 is fixed, respectively, because the loop 66 is connected through the fastening ring 68 to the attaching portion on the inner wall of the container. Furthermore, the free end of the belt member 50 is pulled in the direction P so as to make smaller the loop 66 to cause the vertex of the corner to approach the attaching portion on the inner wall of the container.

In hanging and extending the inner bag in a container, therefore, the loop 66 of the belt member is made smaller to give tension to the inner bag so as not to cause any slack, thereby eliminating or preventing the slack of the bag. Accordingly, complete support of the inner bag and removal and prevention of slack of the bag can be accomplished with the simple construction without requiring any slack preventing rope as used in the prior art.

Moreover, as the inner bag is supported at locations where the buckles 58, the annular bodies 64 and the fixed ends 52 of the belt members 50 are fixed, to avoid the point support of the bag as in the prior art, it is possible to mitigate the stress concentration which would cause damage or breakdown of the inner bag.

Figure 4:
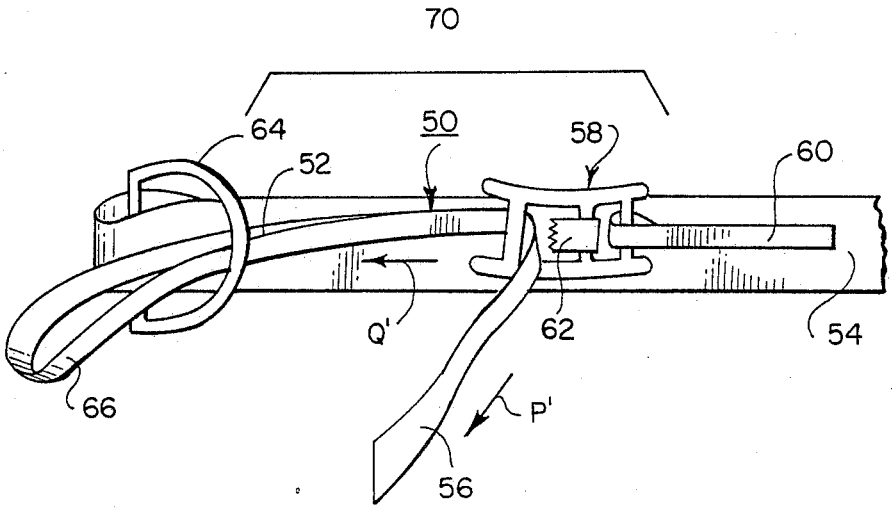
FIG. 4 is a perspective view illustrating an auxiliary fastener preferably used in the invention.

FIG. 4 is an enlarged perspective view illustrating an important part of the lower portion of the inner bag of the container shown in FIG. 2. In order to make more effective the invention, an auxiliary fastener shown in FIG. 4 to be explained hereinafter is preferably provided on the inner bag of the container. Corresponding parts to those in FIGS. 2 and 3 are designated by the same reference numerals as those in the previous embodiment and will not be described in more detail.

In FIG. 4, the auxiliary fastener 70 includes an annular body 64 fixed to a belt cloth 54 which is fixed to a side edge of an inner bag along a lower edge c of a side surface 40, and a buckle 58 fixed through a belt member 60 to the belt cloth 54. Moreover, a fixed end 52 of a belt member 50 is fixed to the belt cloth 54 between the buckle 58 and the annular body 64, and a free end 56 of the belt member 50 is held by the buckle 58. A part of the belt member 50 between the fixed and free ends 52 and 56 forms a loop 66 with the aid of the annular body 64. In this case, the loop 66 is connected through a fastening ring 68 to an attaching portion on the inner wall of the container.

With this arrangement, when the free end 56 is pulled in a direction shown by an arrow P', the buckle 58 is moved toward the annular body 64 provided at the vertex of the corner. The loop 66 is connected to the attaching portion on the inner wall of the container. Following to the buckle 58, therefore, the side edge of the inner bag along the edge c is novel to the corner, thereby applying tensile force to eliminate or prevent slack of the bag along the edge c. A direction shown by an arrow Q' in FIG. 4 is along the belt member 50 and opposite to the direction P'.

By providing the auxiliary fastener and the hanging device in the above embodiment on any suitable corners of an inner bag for a container, the slack of the bag is eliminated or prevented, while the inner bag is simply and quickly hung and extended in the container.

This invention is not limited to the above embodiments, and configurations, positional relations, fixed positions and fixing means of the belt members, annular bodies and buckles may be modified favorably at will depending upon requirements in designing.

For example, any buckles having different construction from those of the buckles shown may be used so long as the belt member can be pulled in one direction such as the direction P or P', but cannot be pulled in the other direction, as the direction Q or Q'. For example, a buckle for a belt for a trousers may be used.

The annular body may be of any annular shape so long as it is able to form a loop of a belt member passing through the annular body. The belt member may be ribbon-shaped strap, mesh strap or other any shaped belt members.

This invention may be applied to various kinds of cases or bags, for example, inner bags for containers, vessels in the form of mosquito nets and other cases. Moreover, the fastening ring may be of any suitable construction without being limited to that shown in the embodiments.

As can be seen from the above description, the case hanging device according to the invention can eliminate or prevent the slack of the case or bag when it is being hung and extended, and mitigate the stress concentration caused at parts of the bag being hung.

While the invention has been particularly shown and described with reference to preferred embodiments thereof, it will be understood by those skilled in the art that the foregoing and other changes in form and details can be made therein without departing from the spirit and scope of the invention.

We claim:

1. A flexible case hanging device comprising a belt member having one end fixed to a side edge along one edge of a corner of a case and a free end anchored by a buckle provided on a side edge along the other edge of the corner, and an annular body provided at a vertex of said corner, part of said belt member passing through said annular body to form a loop of the belt member, which is adjustable into smaller sizes by pulling said free end of the belt member.

2. A flexible case hanging device as set forth in claim 1, wherein said buckle is provided with a stopper which is inoperative when said free end of the belt member is pulled in one direction but is operative to anchor said free end of the belt member when said free end is pulled in a direction substantially opposite to said one direction.

3. A flexible case hanging device as set forth in claim 1, wherein there is provided a ring passing through said loop, the ring being fixed to a member to which the case is hung.

4. A flexible case hanging device as set forth in claim 1, wherein said device further comprises an auxiliary fastener which comprises a belt cloth fixed to a side edge along an edge of the case, an annular body fixed to the belt cloth, a buckle fixed to the belt cloth on a side opposite to said annular body, and a belt member having one end fixed to the belt cloth between said annular body and said buckle and the other free end anchored by said buckle, part of said belt member passing through said annular body to form a loop of the belt member, which is adjustable into smaller sizes by pulling said free end of the belt member.

5. A flexible case hanging device as set forth in claim 4, wherein said buckle of the auxiliary fastener is provided with a stopper which is inoperative when said free end of the belt member is pulled in one direction but is operative to anchor said free end of the belt member when said free end is pulled in a direction substantially opposite to said one direction.

* * * * *